US011560762B2

(12) United States Patent
Gruess et al.

(10) Patent No.: US 11,560,762 B2
(45) Date of Patent: Jan. 24, 2023

(54) ELEVATOR LOCKING SYSTEM APPARATUS AND METHODS

(71) Applicant: FORUM US, INC., Houston, TX (US)

(72) Inventors: Arno Gruess, Klein Nordende (DE); Frederik Stoldt, Hamburg (DE); Andre Vierke, Hamburg (DE)

(73) Assignee: Forum US, Inc., Houston, TX (US)

( * ) Notice: Subject to any disclaimer, the term of this patent is extended or adjusted under 35 U.S.C. 154(b) by 358 days.

(21) Appl. No.: 16/850,821

(22) Filed: Apr. 16, 2020

(65) Prior Publication Data

US 2021/0324690 A1 Oct. 21, 2021

(51) Int. Cl.

| | |
|---|---|
| ***E21B 19/07*** | (2006.01) |
| ***E21B 19/10*** | (2006.01) |
| ***E21B 17/04*** | (2006.01) |

(52) U.S. Cl.

CPC ..... *E21B 19/07* (2013.01); *E21B 17/04* (2013.01); *E21B 19/10* (2013.01)

(58) Field of Classification Search

CPC ..... E21B 19/06; E21B 19/07; E21B 19/10
See application file for complete search history.

(56) References Cited

U.S. PATENT DOCUMENTS

| | | | |
|---|---|---|---|
| 2,491,711 | A | 12/1949 | Calhoun |
| 4,269,554 | A | 5/1981 | Jackson |
| 4,511,168 | A | 4/1985 | Haynes |
| 4,604,724 | A | 8/1986 | Shaginian et al. |
| 5,791,410 | A | 8/1998 | Castille et al. |
| 7,055,333 | B2 | 6/2006 | Leitch et al. |
| 7,182,133 | B2 | 2/2007 | Webre et al. |
| 8,141,923 | B2 | 3/2012 | Bouligny et al. |
| 8,733,454 | B2 | 5/2014 | Bouligny et al. |
| 2007/0131416 | A1 | 6/2007 | Odell, II et al. |

(Continued)

FOREIGN PATENT DOCUMENTS

| | | | |
|---|---|---|---|
| DE | 102004061381 | A1 | 7/2006 |
| EP | 1916344 | A2 | 4/2008 |
| WO | 1994007068 | A1 | 3/1994 |

OTHER PUBLICATIONS

"Door" Definition by Merriam-Webster. Accessible from https://www.merriam-webster.com/dictionary/door (Year: 2019).

(Continued)

*Primary Examiner* — Kristyn A Hall
(74) *Attorney, Agent, or Firm* — Patterson + Sheridan, LLP

(57) ABSTRACT

Aspects of the disclosure relate to elevator locking system apparatus and methods, and associated components thereof. In one implementation, a slip-type elevator assembly includes an elevator body including one or more slips configured to grip a tubular, and a first door pivotably coupled to the elevator body. The slip-type elevator assembly includes a second door pivotably coupled to the elevator body, the first door and the second door movable between an open position and a closed position. The slip-type elevator assembly also includes a locking system including a bolt movable between an unlocked position and a locked position. In the unlocked position the bolt is disposed in a first cavity formed in the first door. In the locked position a first portion of the bolt is disposed in the first cavity and a second portion of the bolt is disposed outside of the first cavity.

19 Claims, 6 Drawing Sheets

(56) References Cited

U.S. PATENT DOCUMENTS

| | | | | |
|---|---|---|---|---|
| 2009/0120649 | A1* | 5/2009 | Cerovsek | E21B 19/06 166/380 |
| 2009/0252589 | A1 | 10/2009 | Sonneveld et al. | |
| 2009/0272542 | A1 | 11/2009 | Begnaud et al. | |
| 2013/0104367 | A1 | 5/2013 | Childress, II et al. | |
| 2015/0021946 | A1 | 1/2015 | Merke et al. | |
| 2016/0356104 | A1* | 12/2016 | Vierke | E21B 19/06 |
| 2018/0340379 | A1 | 11/2018 | Gruess et al. | |

OTHER PUBLICATIONS

Non-Final Office Action dated Dec. 31, 2018 for U.S. Appl. No. 15/604,778.
Final Office Action dated Aug. 6, 2019 for U.S. Appl. No. 15/604,778.
Non-Final Office Action dated Apr. 9, 2020 for U.S. Appl. No. 15/604,778.

* cited by examiner

ELEVATOR LOCKING SYSTEM APPARATUS AND METHODS

BACKGROUND

Field

Aspects of the disclosure relate to elevator locking system apparatus and methods, and associated components thereof. In one example, the elevator locking system apparatus and methods are used in relation to elevators that lift and manipulate tubulars, such as casing tubulars.

Description of the Related Art

Slip-type elevators can incur high "belt forces" during operation. Belt forces are the forces applied by the slips radially outward to the body and doors of the elevator when supporting a tubular. The belt forces try to force open the doors of the elevator when the doors are locked together, which may cause damage to one or more components of the elevator, specifically a latch that is used to lock the doors together. The damage to the latch or the doors can result in structural failures, operational failures, and decreased reliability. It is difficult therefore for slip-type elevators to handle large loads.

Therefore, there is a need for new and improved elevator systems.

SUMMARY

Aspects of the disclosure relate to elevator locking system apparatus and methods, and associated components thereof. In one example, the elevator locking system apparatus and methods are used in relation to elevators that lift and manipulate tubulars, such as casing tubulars.

In one implementation, a slip-type elevator assembly includes an elevator body including one or more slips configured to grip a tubular, and a first door pivotably coupled to the elevator body. The slip-type elevator assembly includes a second door pivotably coupled to the elevator body, the first door and the second door movable between an open position and a closed position. The slip-type elevator assembly also includes a locking system including a bolt movable between an unlocked position and a locked position. In the unlocked position the bolt is disposed in a first cavity formed in the first door. In the locked position a first portion of the bolt is disposed in the first cavity and a second portion of the bolt is disposed outside of the first cavity.

In one implementation, a slip-type elevator assembly includes an elevator body including one or more slips configured to grip a tubular, and a first door pivotably coupled to the elevator body. The first door includes a plurality of first protrusions. The slip-type elevator assembly also includes a second door pivotably coupled to the elevator body, the second door including one or more second protrusions. The first door and the second door are movable between an open position and a closed position. In the closed position the plurality of first protrusions are interleaved with the one or more second protrusions. The slip-type elevator assembly also includes a locking system including a bolt disposed in a first cavity formed in the first door and being movable between an unlocked position and a locked position. The bolt includes a first end and a second end. In the unlocked position the first end and the second end are disposed within the first cavity. In the locked position the first end is disposed within the first cavity and the second end is disposed outside of the first cavity.

In one implementation, a method of manipulating a tubular using a slip-type elevator includes disposing the tubular into a central opening of an elevator body. The method includes closing a first door and a second door about the tubular, the first door including a first cavity formed in a first protrusion and a bolt disposed in the first cavity in an unlocked position. The closing includes pivoting the first door and the second door relative to the elevator body and towards each other, and aligning the first cavity with a second cavity formed in a second protrusion of the second door. The method also includes locking the first door and the second door together by moving the bolt at least partially into the second cavity formed in the second protrusion to a locked position. The method also includes gripping the tubular with the slips, and lifting or lowering the tubular.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
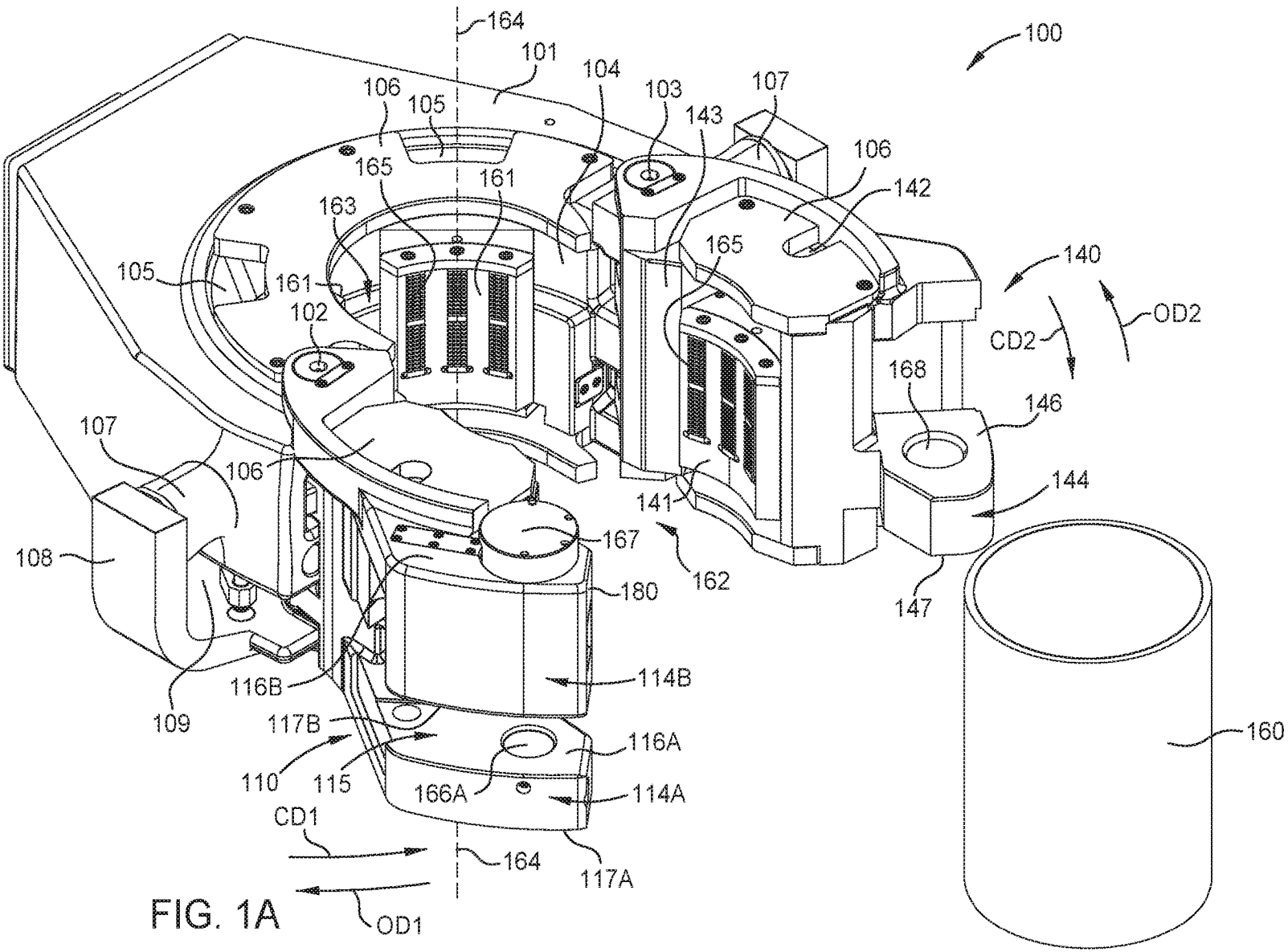
FIG. 1A is a schematic front isometric partial illustration of a slip-type elevator assembly with a first door and a second door in an open position, according to one implementation.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Aspects of the disclosure relate to elevator locking system apparatus and methods, and associated components thereof. In one example, the elevator locking system apparatus and methods are used in relation to elevators that lift and manipulate tubulars, such as casing tubulars.

Terms such as "couples," "coupling," "couple," and "coupled" may include welding, interference fitting, and/or fastening such as by using bolts, threaded connections, and/or screws. Terms such as "couples," "coupling," "couple," and "coupled" may include direct coupling and/or indirect coupling.

Figure 1B:
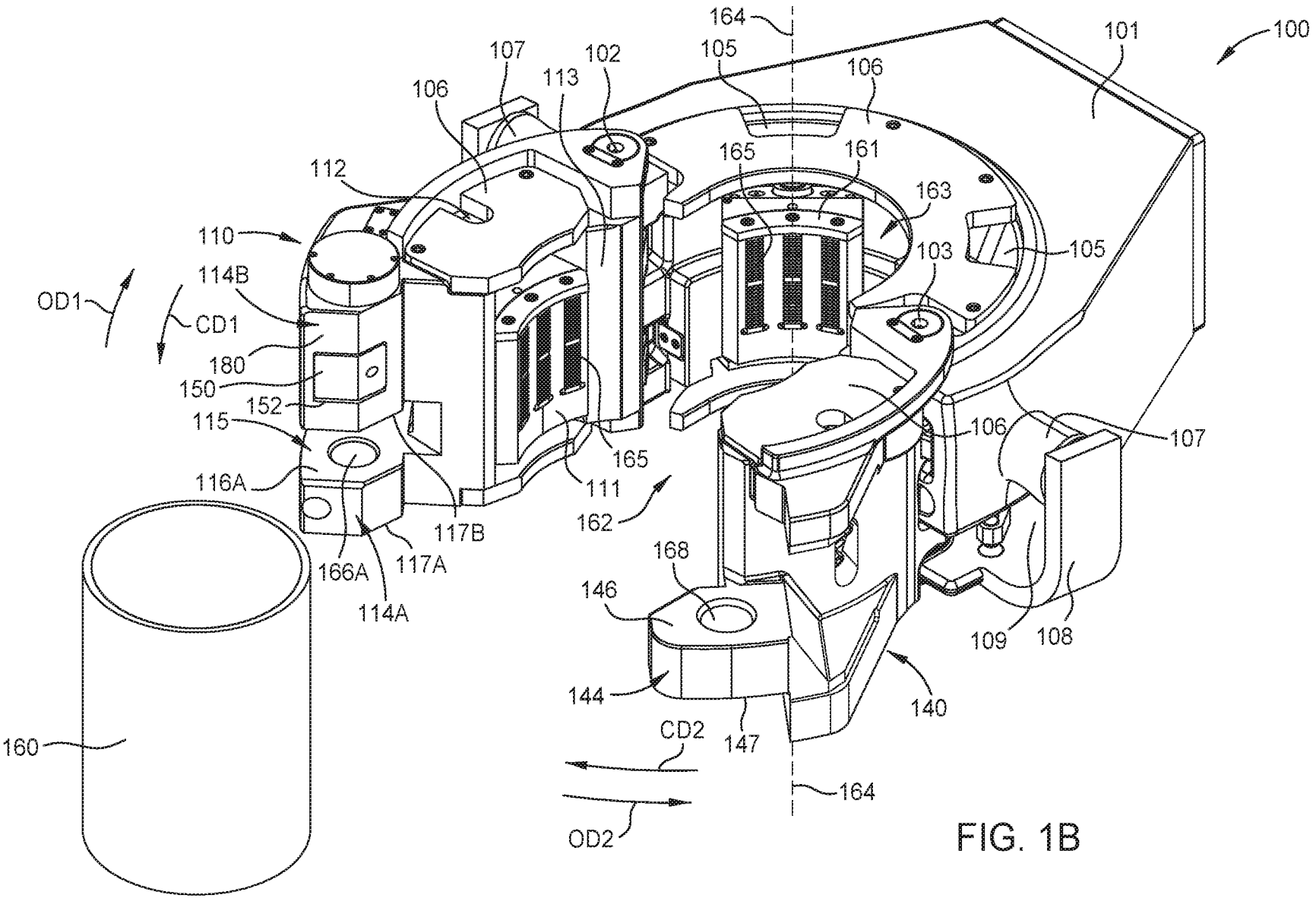
FIG. 1B is a schematic back isometric partial illustration of the slip-type elevator assembly illustrated in FIG. 1A, according to one implementation.

FIG. 1A is a schematic front isometric partial illustration of a slip-type elevator assembly 100 with a first door 110 and a second door 140 in an open position, according to one implementation. FIG. 1B is a schematic back isometric partial illustration of the slip-type elevator assembly 100 illustrated in FIG. 1A, according to one implementation. The slip-type elevator assembly 100 includes an elevator body 101, the first door 110 pivotably coupled to the elevator body 101, and the second door 140 pivotably coupled to the elevator body 101. The first door 110 is configured to pivot about a first pivot point 102 relative to the elevator body 101, and the second door 140 is configured to pivot about a second pivot point 103 relative to the elevator body 101.

The elevator body 101 includes an interior surface 104 and one or more angled surfaces 105 (two are shown) formed adjacent the interior surface 104. The angled surfaces 105 are formed into the interior surface 104. The one or more angled surfaces 105 formed adjacent the interior surface 104 may be formed into one or more inserts that are coupled to the elevator body 101. One or more guide plates 106 (three are shown) are coupled to the elevator body 101. The slip-type elevator assembly 100 includes a pair of elevator ears 107, a pair of ear bars 108, and a pair of lift gaps 109. A pair of links may be disposed through the lift gaps 109 and used to lift or lower the slip-type elevator assembly 100 to manipulate a tubular 160. A portion of the tubular 160 is illustrated in FIG. 1A. The tubular 160 may be a casing tubular. The slip-type elevator assembly 100 may be used to lift casing tubulars without additional lift knobbens or lift subs attached to the casing tubulars, which eliminates operational time and operational expenses required when using additional lift knobbens or lift subs.

The slip-type elevator assembly 100 includes one or more slips 161 (two are shown) disposed respectively on the one or more angled surfaces 105. The slips 161 may move up and down along the angled surfaces 105. Each slip 161 includes an angled back surface that interfaces with and slides along the respective angled surface 105. The slips 161 are slidable up and down along the angled surfaces 105 to grip and release the tubular 160 using the slip-type elevator assembly 100. The slip-type elevator assembly 100 grips or releases the tubular 160 by action of the slips 161 which provide a gripping action as a downward force is applied to the slips 161 by the weight of the tubular 160 and release the gripping action as the tubular 160 is moved upwardly relative to the elevator body 101, the first door 110, and the second door 140.

The first door 110 includes a one or more slips 111 disposed on one or more angled surfaces 112 formed adjacent an interior surface 113 of the first door 110. The second door 140 includes one or more slips 141 disposed on one or more angled surfaces 142 formed adjacent an interior surface 143 of the second door 140. The one or more angled surfaces 112 are formed into the interior surface 113 of the first door 110, and the one or more angled surfaces 142 are formed into the interior surface 143 of the second door 140. The angled surfaces 112, 142 may be formed in inserts coupled to the first door 110 and the second door 140. The slips 111, 141 are similar to the slips 161 described above and may include one or more of the same features, components, aspects, and/or properties thereof.

The first door 110 includes a plurality of first protrusions 114A, 114B (two are shown) that protrude from the first door 110. The first protrusions 114A, 114B may protrude radially outward from the first door 110 relative to the central longitudinal axis 164, radially inward from the first door 110 relative to the central longitudinal axis 164, and/or tangentially from the first door 110 relative to the central longitudinal axis 164. The first protrusions 114A, 114B may protrude vertically upward and/or downward from the first door 110. The first door 110 includes one or more first openings 115 (one is shown). Each of the first openings 115 is disposed between two of the first protrusions 114A, 114B. The plurality of first protrusions 114A, 114B includes a lower first protrusion 114A and an upper first protrusion 114B.

The second door 140 includes one or more second protrusions 144 (one is shown) that protrude from the second door 140. The second protrusions 144 may protrude radially outward from the second door 140 relative to the central longitudinal axis 164, radially inward from the second door 140 relative to the central longitudinal axis 164, and/or tangentially from the second door 140 relative to the central longitudinal axis 164. The second protrusions 144 may protrude vertically upward and/or downward from the second door 140.

The slip-type elevator assembly 100 includes a first actuator to pivot the first door 110 about the first pivot point 102 and a second actuator to pivot the second door 140 about the second pivot point 103. The first and second actuators may be hydraulic, electric, spring loaded, and/or pneumatic actuators. The first and second actuators may each include a cylinder that extends and retracts to pivot the first and second door, respectively. The first and second doors 110, 140 may each include a lever. The first and second actuators may each couple to the respective levers of the first and second doors 110, 140 to facilitate pivoting the first door 110 and the second door 140.

The first door 110 and the second door 140 are illustrated in the open position in FIG. 1A. When the first door 110 and the second door 140 are in the open position, the slip-type elevator assembly includes a throat 162 that is open to receive the tubular 160. When the doors 110, 140 are open the tubular 160 may be disposed in a central opening 163 of the elevator body 101 by moving the tubular 160 through the throat 162 and into the central opening 163. The tubular 160 can be moved into the central opening using movement of the tubular 160 and/or movement of the elevator body 101. The tubular 160 may engage the slips 161 of the elevator body 101 upon moving into the central opening 163. The central longitudinal axis 164 extends linearly through a center of the central opening 163. The central longitudinal axis 164 extends orthogonally to a horizontal plane that extends from one elevator ear of the pair of elevator ears 107 to the other elevator ear of the pair of elevator ears 107. The central longitudinal axis 164 is aligned with a central longitudinal axis of the tubular 160 when the tubular is disposed within the central opening 163. The central longitudinal axis 164 defines a vertical direction. Terms such as "vertical" or "vertically" used herein are contemplated to be along the central longitudinal axis 164. Terms such as "horizontal" or "horizontally" user herein are contemplates to be orthogonal to the central longitudinal axis 164. Vertically relative terms such as "upper", "lower," "upward," "downward," "below," and "above" used herein are taken along the central longitudinal axis 164.

Figure 1C:
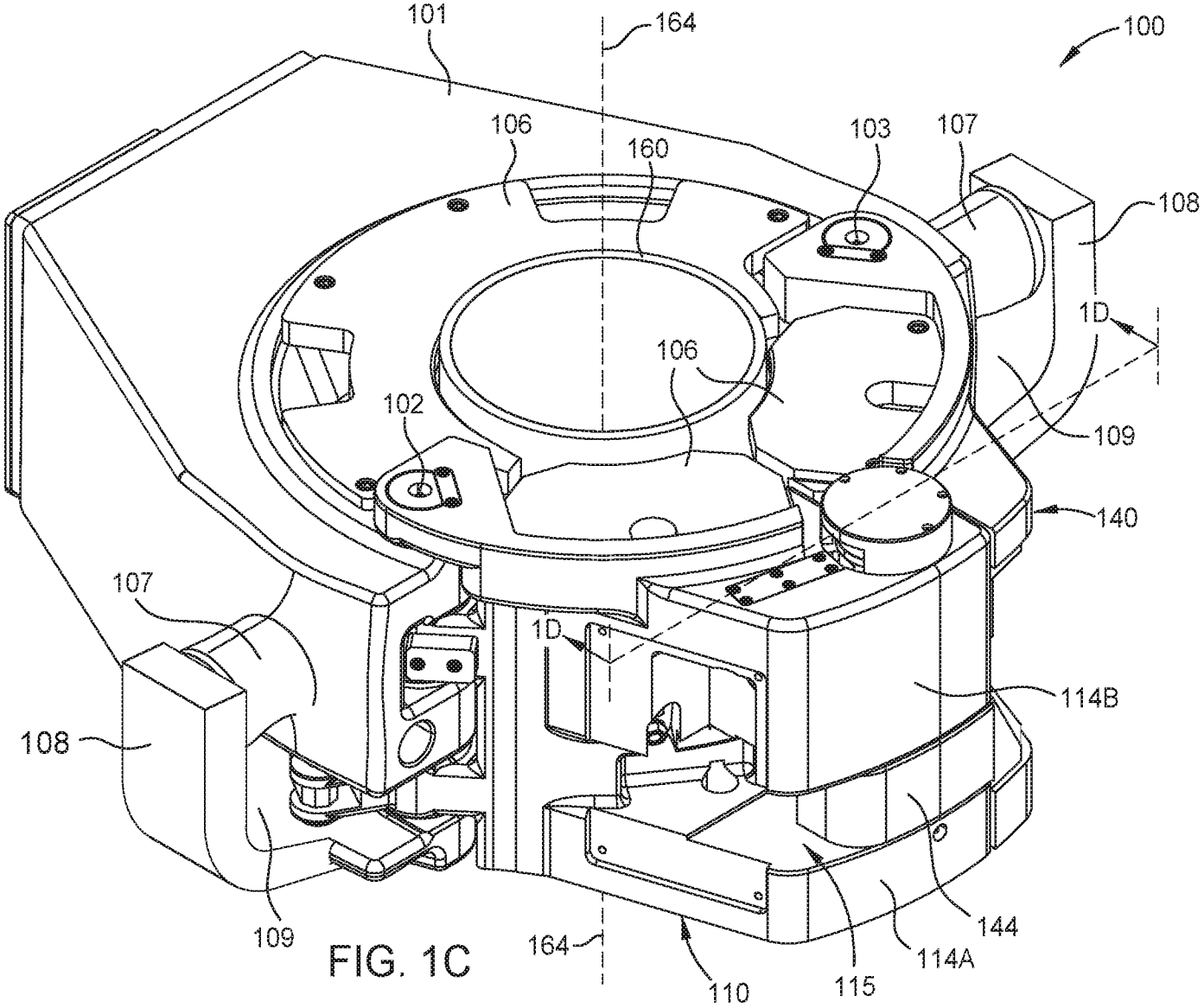
FIG. 1C is a schematic front isometric partial illustration of the slip-type elevator assembly illustrated in FIGS. 1A and 1B with the first door and the second door in the closed position, according to one implementation.

The first actuator actuates to pivot the first door 110 in a rotational closing direction CD1 (illustrated in FIGS. 1A and 1B) and move the first door 110 into a closed position as shown in FIG. 1C. The second actuator actuates to pivot the second door 140 in a rotational closing direction CD2 (illustrated in FIGS. 1A and 1B) and move the second door 114 into a closed position as shown in FIG. 1C. When in the closed positions, the first door 110 and the second door 140 are closed about the tubular 160 to close the throat 162. The slips 111, 141 of the first and second doors 110, 140 may engage the tubular 160 as the doors 110, 140 pivot to close about the tubular 160. When the tubular 160 is to be released from the slip-type elevator assembly 100 after a tubular handling operation, the first and second actuators are actuated to pivot the first door 110 in a rotational opening direction OD1 and pivot the second door 140 in a rotational opening direction OD2, as illustrated in FIGS. 1A and 1B. The first and second doors 110, 140 pivot to the open position, re-opening the throat 162.

FIG. 1C is a schematic front isometric partial illustration of the slip-type elevator assembly 100 illustrated in FIGS. 1A and 1B with the first door 110 and the second door 140 in the closed position, according to one implementation. Once in the closed position, and after moving a locking system into a locked position (as discussed in relation to FIG. 1D below), the slip-type elevator assembly 100 may be used to lift or lower the tubular 160. The tubular 160 is supported on the slip-type elevator assembly 100 using the slips 111, 141 of the doors 110, 140 and the slips 161 of the elevator body 101. The slips 161 and the slips 111, 141 include gripping elements 165 (illustrated in FIGS. 1A and 1B) that grip an outer surface of the tubular 160. The gripping elements 165 may include any gripping element, such as dies, teeth, and/or buttons. The gripping elements 165 of the slips 161 and the slips 111, 141 generate a force on the tubular 160 sufficient to grip and hold the tubular 160 when the tubular 160 is suspended from the slip-type elevator assembly 100 during a tubular handling operation.

Figure 1D:
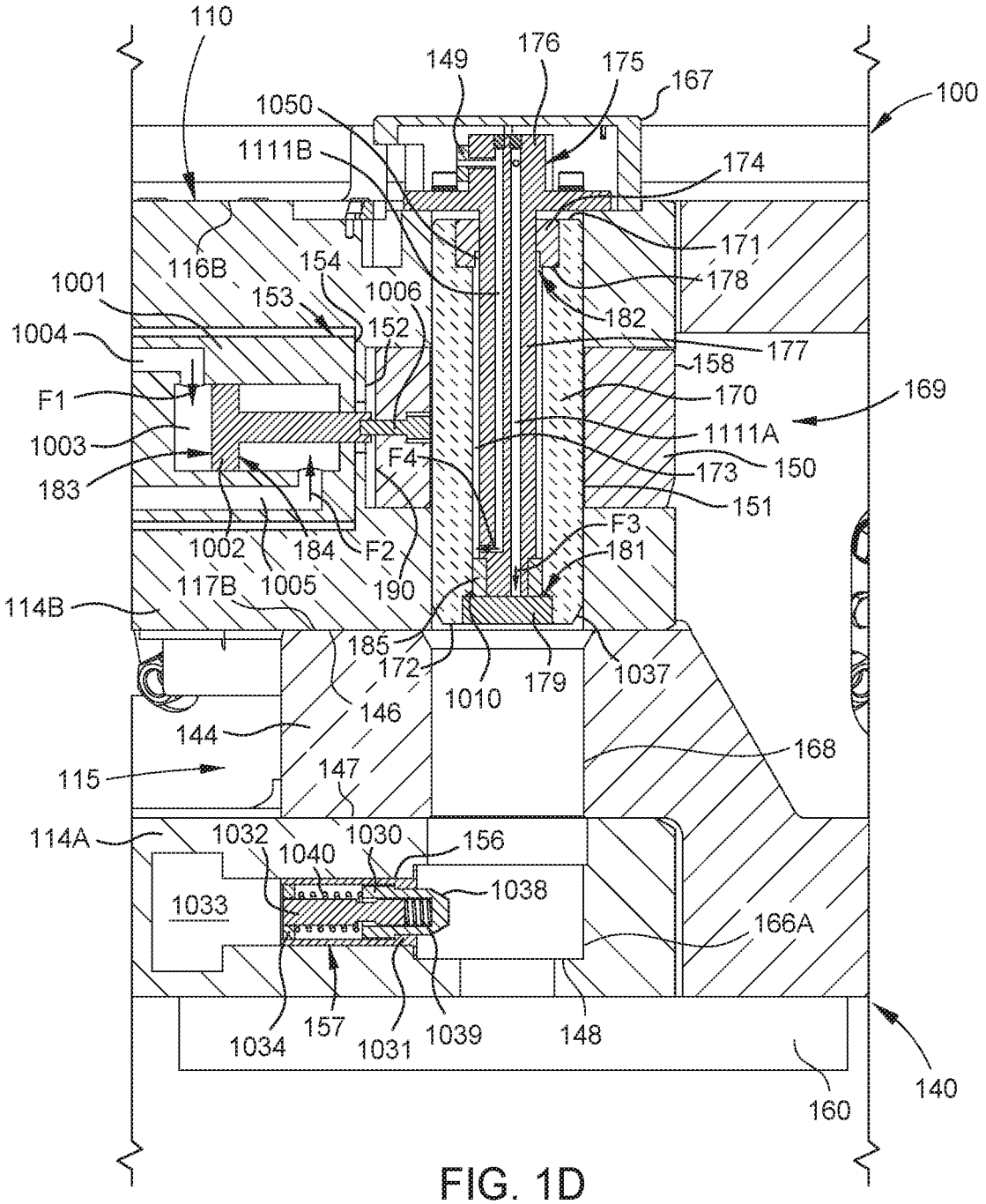
FIG. 1D is a schematic cross-sectional partial illustration of the slip-type elevator assembly illustrated in FIGS. 1A, 1B, and 1C with a bolt in an unlocked position, taken along lines 1D-1D as shown in FIG. 1C, according to one implementation.

FIG. 1D is a schematic cross-sectional partial illustration of the slip-type elevator assembly 100 illustrated in FIGS. 1A, 1B, and 1C with a bolt 170 (of a locking system further described below) in an unlocked position, taken along lines 1D-1D as shown in FIG. 1C, according to one implementation. The first door 110 and the second door 140 are illustrated in the closed position. The bolt 170 is in the unlocked position when the first and second doors 110, 140 are in the open position, as illustrated in FIGS. 1A and 1B. In the closed position, the first protrusions 114A, 114B of the first door 110 are interleaved with the one or more second protrusions 144 of the second door 140. The second protrusion 144 is disposed in the first opening 115 between the upper first protrusion 114B and the lower first protrusion 114A.

The lower first protrusion 114A includes an upper surface 116A and a lower first cavity 166A formed in the upper surface 116A. The lower first cavity 166A extends at least partially into the lower first protrusion 114A to form a shoulder 148. The upper first protrusion 114B includes an upper surface 116B, a lower surface 117B, and an upper first cavity 166B formed in the upper first protrusion 114B. The upper first cavity 166B extends between the upper surface 116B and the lower surface 117B. A cover 167 is disposed on the upper surface 116B.

The second protrusion 144 includes an upper surface 146, a lower surface 147, and a second cavity 168 extending from the upper surface 146 to the lower surface 147. The lower surface 147 of the second protrusion 144 interfaces with the upper surface 116A of the lower first protrusion 114A. The upper surface 146 of the second protrusion 144 interfaces with the lower surface 117B of the upper first protrusion 114B.

In the closed position of the first door 110 and the second door 140, the lower surface 117B of the upper first protrusion 114B interfaces with the upper surface 146 of the second protrusion 144, and the lower surface 147 of the second protrusion 144 interfaces with the upper surface 116A of the lower first protrusion 114A.

The slip-type elevator assembly 100 includes a locking system 169. The locking system 169 includes a guide rod 175 disposed in the upper first cavity 166B. The guide rod 175 is mounted to the first door 110. The locking system 169 includes the bolt 170. In one example, the bolt 170 is a shear pin. The bolt 170 includes a first end 171 and a second end 172. The bolt 170 includes an upper internal chamber 173 disposed above a lower head 185 of the guide rod 175 and a lower internal chamber 100 disposed below the lower head 185. The lower internal chamber 1010 is sealed by a plug 179 (such as a seal) disposed adjacent the second end 172 of the bolt 170. The guide rod 175 includes an upper head 176 fixedly mounted to the upper first protrusion 114B of the first door 110 and a shaft 177 that extends into the upper first cavity 166B. A nut 174 (for example, a head nut) is disposed in a recessed shoulder 178 formed into the first end 171 of the bolt 170. The nut 174 is threadably coupled to the bolt 170. The bolt 170 and the nut 174 are slidably disposed about the shaft 177 of the guide rod 175. A seal may be disposed between the nut 174 and the shaft 177. The nut 174 seals the upper internal chamber 173 and facilitates guiding the bolt 170 along the shaft 177 of the guide rod 175. The bolt 170 and the nut 174 are movable relative to the guide rod 175 and the upper first protrusion 114B of the first door 110 in response to a differential pressure acting on the bolt 170. In one example, the lower first cavity 166A is a first vertical cavity, the second cavity 168 is a second vertical cavity, and the upper first cavity 166B is a third vertical cavity.

The guide rod 175 includes one or more fluid openings (a first fluid opening 1111A and a second fluid opening 1111B are shown) formed therein. The first fluid opening 1111A supplies and exhausts a third pressurized fluid F3 to and from the lower internal chamber 1010 of the bolt 170. The second fluid opening 1111B supplies and exhausts a fourth pressurized fluid F3 to and from the upper internal chamber 173 of the bolt 170. A fluid conduit 149 is fluidly connected to the first fluid opening 1111A to facilitate supplying and/or exhausting the third pressurized fluid F3. The fluid conduit 149 is fluidly connected to a fluid source that supplies the third pressurized fluid F3 to the fluid conduit 149. The pressurized fluid may include one or more of a hydraulic fluid and/or a pneumatic fluid. A second fluid conduit is fluidly connected to the second fluid opening 1111B to facilitate supplying and/or exhausting the fourth pressurized fluid F4. The fluid conduit 149, the second fluid conduit and the first and second fluid openings 1111A, 1111B are part of a first fluid supply of the locking system 169.

The locking system 169 further includes a travel block 150 movably disposed in a first horizontal cavity 152 formed in the upper first protrusion 114B. The travel block 150 includes a central opening 151 formed therethrough. A first hydraulic actuator 153 is horizontally disposed in a second horizontal cavity 154 formed in the upper first protrusion 114B. The first hydraulic actuator 153 is coupled to the travel block 150 to move the travel block 150 in the first horizontal cavity 152 by pushing and pulling on the travel block 150. The first hydraulic actuator 153 includes a hydraulic cylinder 1001 and a piston rod 1002 including a head. The hydraulic cylinder 1001 includes an internal chamber 1003. The head of the piston rod 1002 is disposed in the internal chamber 1003. The hydraulic cylinder 1001 is coupled to the upper first protrusion 114B, such as by using fasteners. The hydraulic cylinder 1001 includes a first fluid opening 1004 and a second fluid opening 1005.

The first fluid opening 1004 supplies a first pressurized fluid F1 into the internal chamber 1003 on a first side 183 of the head of the piston rod 1002 to pressurize the first side 183 of the head of the piston rod 1002. Pressurizing the first side 183 of the head of the piston rod 1002 moves the piston rod 1002 outwardly relative to the hydraulic cylinder 1001. The piston rod 1002 is coupled to the travel block 150 using a piston screw 1006 that is coupled to the travel block 150. Movement of the piston rod 1002 moves the travel block 150 in the same direction. The second fluid opening 1005 supplies a second pressurized fluid F2 into the internal chamber 1003 on a second side 184 of the head of the piston rod 1002 to pressurize the second side 184 of the head of the piston rod 1002. Pressurizing the second side 184 of the head of the piston rod 1002 moves the piston rod 1002, and hence the travel block 150, inwardly relative to the hydraulic cylinder 1001.

The first fluid opening 1004 and the second fluid opening 1005 may be fluidly connected to one or more fluid sources that supply pressurized fluid to the first fluid opening 1004 and the second fluid opening 1005. The pressurized fluid may include one or more of a hydraulic fluid, such as oil, and/or a pneumatic fluid. The first horizontal cavity 152 and the second horizontal cavity 154 are spaced relative to each other such that portions of the upper first protrusion 1146 are disposed between the first horizontal cavity 152 and the second horizontal cavity 154.

In the unlocked position illustrated in FIG. 1D, the bolt 170 and the nut 174 are in an upper position. The bolt 170 and the nut 174 are movable between the upper position and a lower position relative to the upper first protrusion 1146. In the unlocked position, bolt 170 is entirely disposed within the upper first protrusion 114B of the first door 110. The first end 171 and the second end 172 are both either coplanar with or above the lower surface 117B of the upper first protrusion 114B. In one example, the plug 179 coupled to the bolt 170 is engaged with a lower side of the lower head 185 (such as a ring) disposed at a lower end of the guide rod 175. The lower side of the lower head 185 may act as a vertical stop for the bolt 170 as the bolt 170 is held upward in the unlocked position. In one example, the bolt 170 and/or the nut 174 are engaged with the upper head 176 of the guide rod 175. In such an example, the upper head 176 may act as a vertical stop for the bolt 170 in the unlocked position either alternatively or in addition to the lower side of the lower head 185 acting as a vertical stop. In the unlocked position, the first end 171 and the second end 172 are within the upper first cavity 1666 of the upper first protrusion 1146.

In the unlocked position illustrated in FIG. 1D, the travel block 150 is in an inward position relative to the upper first protrusion 1146. The travel block 150 is movable along the first horizontal cavity 152 between the inward position and an outward position. The travel block 150 is movable in response to a differential pressure applied to the head of the piston rod 1002 in the internal chamber 1003. In one example, the first side 183 is pressurized relative to the second side 184 to move the travel block 150. The travel block 150 includes a first end 190 and a second end 158. In one example, the second end 158 is exposed to ambient air at an ambient pressure. In the inward position, the travel block 150 is entirely disposed within the upper first protrusion 114B of the first door 110. In the inward position, the first end 190 and the second end 158 of the travel block 150 are disposed inward of an exterior surface 180 of the upper first protrusion 114B. In the inward position, the first end 190 is engaged with the portions of the upper first protrusion 114B that are disposed between the first horizontal cavity 152 and the second horizontal cavity 154. The first horizontal cavity 152 defines a horizontal travel path for the travel block 150. In the unlocked position, the lower first cavity 166A, the upper first cavity 166B, the second cavity 168, and the central opening 151 are vertically aligned to define a vertical travel path for the bolt 170.

Figure 1E:
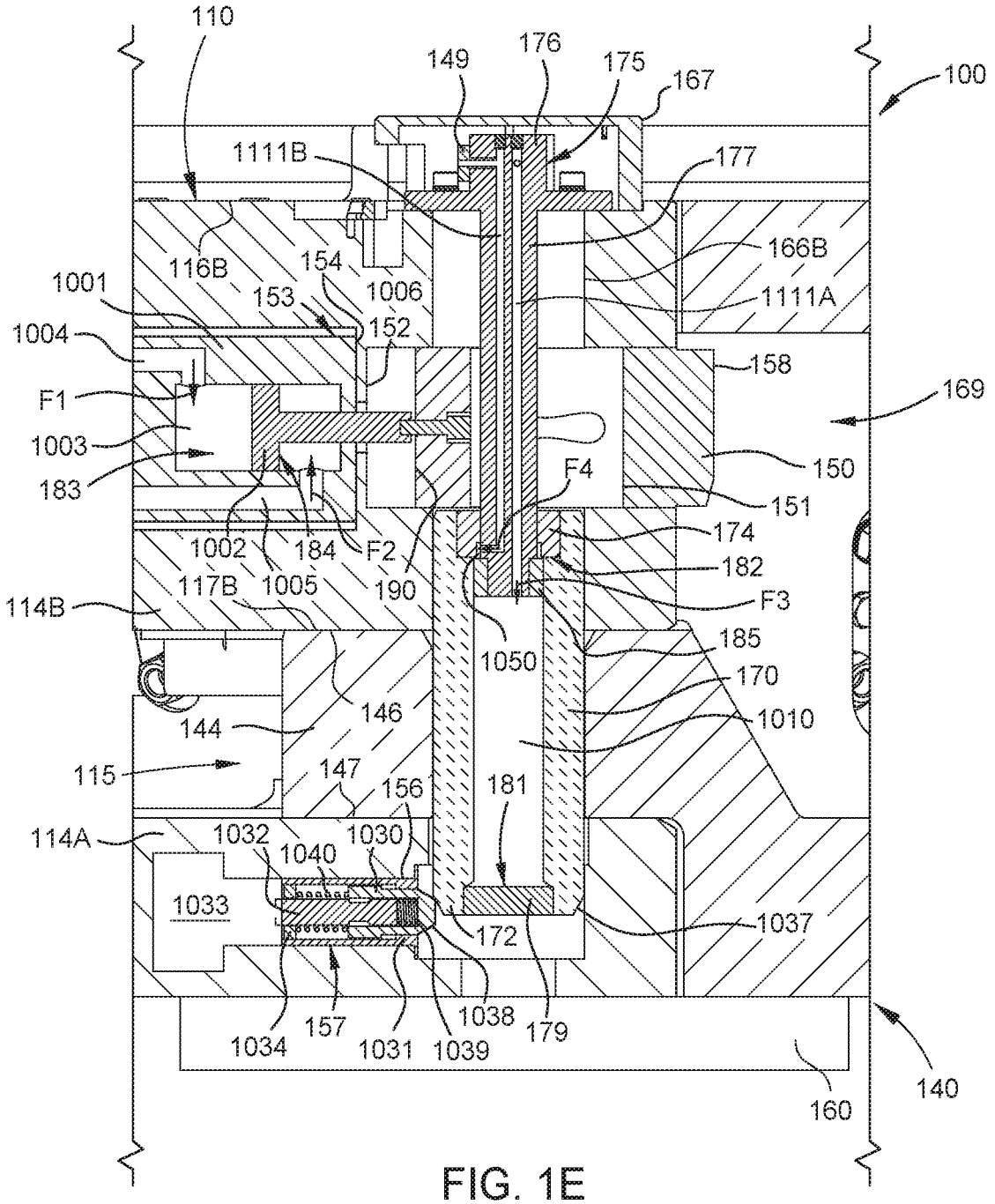
FIG. 1E is a schematic cross-sectional partial illustration of the slip-type elevator assembly illustrated in FIG. 1D with the bolt in a locked position, according to one implementation.

FIG. 1E is a schematic cross-sectional partial illustration of the slip-type elevator assembly 100 illustrated in FIG. 1D with the bolt 170 in a locked position, according to one implementation. In the locked position, the bolt 170 is in the lower position. The bolt 170 has been moved into the locked position from the unlocked position illustrated in FIG. 1D. In one example, the bolt 170 is moved to the locked position using the third pressurized fluid F3 supplied from the first fluid opening 1111A to the upper internal chamber 173, which is sealed by the nut 174. The third pressurized fluid F3 is supplied to the first fluid opening 1111A using the fluid conduit 149. The third pressurized fluid F3 pressurizes a first inner side 181 of the bolt 170 relative to a second inner side 182 of the bolt 170 to move the bolt 170 downwards from the unlocked position to the locked position. As the bolt 170 moves downwards fourth pressurized fluid F4 in the upper internal chamber 173 exhausts through the second fluid opening 1111B. In the locked positon, the first end 171 of the bolt 170 is above the lower surface 117B of the upper first protrusion 114B, and the second end 172 is below the upper surface 116A of the lower first protrusion 114A. In the locked position, the second end 172 is outside of the upper first cavity 166B of the upper first protrusion 1146 and within the lower first cavity 166A of the lower first protrusion 114A. In the locked position, the nut 174 coupled to the bolt 170 is engaged with an upper side of the lower head 185 that is coupled to a lower end of the guide rod 175. The upper side of the lower head 185 may act as a vertical stop for the bolt 170 as the bolt 170 moves downward into the locked position. In one example, the lower head 185 is a piston of the guide rod 175 and the bolt 170 is a cylinder for the piston that is the lower head 185.

FIG. 1E also illustrates the travel block 150 in an outward position. The travel block 150 has been moved into the outward position (from the inward position illustrated in FIG. 1D) after the bolt 170 was moved into the locked position. In one example, the travel block 150 is moved to the outward position using the first pressurized fluid F1 supplied to the first side 183 of the head of the piston rod 1002. The first pressurized fluid F1 pressurizes the first side 183 of the head of the piston rod 1002 relative to the second side 184 to move the travel block 150 into the outward position. As the head of the piston rod 1002 moves outward, second pressurized fluid F2 that is on the second side 184 in the internal chamber 1003 is exhausted through the second fluid opening 1005. In the outward position, the central opening 151 of the travel block 150 moves out of alignment from the lower first cavity 166A, the upper first cavity 166B, and the second cavity 168. In the outward position, a portion of the travel block 150 is disposed above the bolt 170 to prevent upward movement of the bolt 170 and maintain the bolt 170 in the locked position. In the outward position, the second end 158 of the travel block 150 is disposed outside of the first horizontal cavity 152 and outward of the exterior surface 180.

An outer surface of the second end 158 provides a visual indication that both the bolt 170 is in the locked position and that the travel block 150 is in the outward position to facilitate maintaining the bolt in the locked position. In one embodiment, which can be combined with other embodiments, the outer surface of the second end 158 that is outside of the exterior surface 180 in the outward position is a color different than a color of the exterior surface 180 to facilitate providing the visual indication. In one example, the color of the outer surface of the second end 158 is red. When the travel block 150 is in the outward position, the red color of the outer surface of the second end 158 is visually recognizable for example by an operator. The present disclosure contemplates that one or more exterior surfaces of the travel block 150 (such as all exterior surfaces of the travel block 150) may include the red color to facilitate providing the visual indication when the portion of the travel block 150 is outside of the exterior surface 180 of the upper first protrusion 114B.

The outer surface of the second end 158 being outside of the exterior surface 180 visually indicates that bolt 170 being in the locked position because the travel block 150 moves from the inward position to the outward position after the bolt 170 moves from the unlocked position to the locked position. For example, the bolt 170 extends at least partially through the central opening 151 when in the locked position to facilitate preventing the travel block 150 from moving to the outward position.

The visual indication of the travel block 150, and the indication provided to an operator using the locking detector 157 and the hydraulic valve 1033 (described below), facilitate reliability of the locking system 169 and verifying that the bolt 170 is maintained in the locked position.

In the locked position, a first portion of the bolt 170 is within the upper first cavity 1666 of the upper first protrusion 1146, a second portion of the bolt 170 is within the second cavity 168 of the second protrusion 144, and a third portion of the bolt 170 is within the lower first cavity 166A of the lower first protrusion 114A. At least two shear points are along the bolt 170. A first shear point is located at the interface of the lower first protrusion 114A and the second protrusion 144, and a second shear point is located at the interface of the upper first protrusion 1146 and the second protrusion 144. The thickness, strength, and placement of the bolt 170 at the shear points are designed to provide sufficient resistance to high belt forces and bending of the bolt 170, the first door 110, and the second door 140 while supporting large loads when compared to conventional elevator systems.

The locking system 169 further includes a horizontal opening 156 formed in the lower first protrusion 114A. The locking system 169 also includes a locking detector 157, in the form of a mechanical feedback device, disposed in the horizontal opening 156. The locking detector 157 includes a button 1030 disposed within a housing 1031, and a shaft 1032 disposed within the housing 1031. The housing 1031 is coupled to a hydraulic valve 1033. The housing 1031 is coupled to the lower first protrusions 114A. The locking detector 157 facilitates detecting when the bolt 170 has moved into the locked position, and providing an indication (such as to an operator) that the bolt 170 is in the locked position. The hydraulic valve 1033 is movable between an open position and a closed position. When in the open position, the hydraulic valve 1033 allows a hydraulic fluid to flow therethrough. When in the closed position, the hydraulic valve 1033 prevents the hydraulic fluid from flowing therethrough. The locking detector 157 also includes a cap 1034 disposed about the shaft 1032 and coupled to the housing 1031.

As the bolt 170 moves downward from the unlocked position to the locked position, a tapered lower surface 1037 of the bolt 170 engages a tapered outer surface 1038 of the button 1030 and pushes the button 1030 inward from an outward position (illustrated in FIG. 1D) to an inward position (illustrated in FIG. 1E). As the button 1030 moves inward, the shaft 1032 is biased inward towards the hydraulic valve 1033 using a first spring 1039 disposed between the shaft 1032 and the button 1030. The shaft 1032 engages the hydraulic valve 1033 and moves the hydraulic valve 1033 from the closed position to the open position, allowing the hydraulic fluid to flow through the hydraulic valve 1033. The hydraulic fluid flowing through the hydraulic valve 1033 provides an indication (such as by generating an electronic signal or a hydraulic signal), that the bolt 170 is in the locked position and first door 110 and the second door 140 are locked together. When the bolt 170 moves upward from the locked position to the unlocked position, the bolt 170 disengages the button 1030 and the button 1030 and the shaft 1032 are biased outward to the outward position using the first spring 1039 and a second spring 1040 disposed between the cap 1034 and the button 1030. The button 1030 and the shaft 1032 moving outward facilitates the shaft 1032 disengaging from the hydraulic valve 1033. The hydraulic valve 1033 then returns to the closed position, blocking flow hydraulic fluid therethrough and facilitating provision of an indication that the bolt 170 is in the unlocked position.

The present disclosure contemplates that the hydraulic valve 1033 may or may not be fluidly connected to the one or more fluid sources that supply and/or exhaust the first pressurized fluid F1, the second pressurized fluid F2, the third pressurized fluid F3, and/or the fourth pressurized fluid F4.

The aspects of the locking system 169 and the slip-type elevator assembly 100 mitigate the effects of high belt forces to reduce or eliminate failures, increase reliability, and increase efficiencies. The high belt forces involve horizontal forces resulting from the slips 161 and the slips 111, 141 supporting the tubular 160. The bolt 170 and the travel block 150 can be disposed entirely in one door (e.g., the first door 110) in the respective locked position and inward position to increase reliability and compactness of the slip-type elevator assembly 100. The compactness reduces a need for a door latch that may bend and break under high belt forces. The compactness also reduces the need for longer bolts that may bend and otherwise require larger thicknesses, facilitating increased efficiencies and increased reliability. The mitigation of belt forces increases reliability and operational efficiencies. The bolt 170 and the travel block 150 being disposed in one door also provides the ability to close and open the first door 110 and the second door 140 simultaneously, facilitating automatic operation of the slip-type elevator assembly 100 rather than manual operation. The aspects of the locking system 169 and the slip-type elevator assembly 100 also reduce repairs that may be needed to fix a conventional door latch that has been bent, which facilitates increased production efficiencies and increases production quality.

The bolt 170 may be moved from the locked position back to the unlocked position such that the first door 110 and the second door 140 may open away from each other. The travel block 150 is moved inward to the inward position by pressurizing the second side 184 of the head of the piston rod 1002 to move the travel block 150 inward. As the head of the piston rod 1002 moves inward, first pressurized fluid F1 that is on the first side 183 in the internal chamber 1003 is exhausted through the first fluid opening 1004. The travel block 150 may be retained in the outward position using one or more check valves disposed in one or more of the first fluid opening 1004 and/or the second fluid opening 1005 to seal the first pressurized fluid F1 on the first side 183 of the head of the piston rod 1002. One or more check valves disposed in one or more of the first and/or second fluid openings 1004, 1005 may also seal the second pressurized fluid F2 on second side 184 of the head of the piston rod 1002 to retain the travel block 150 in the inward position.

An opening 1050 is disposed between the bolt 170 and the nut 174. In one example the opening 1050 is a recess formed in a bottom surface of the nut 174. The opening 1050 facilitates using the fourth pressurized fluid F4 to move the bolt 170 from the locked position to the unlocked position when the bolt 170 is in the locked position and the nut 174 is engaged with and vertically stopped against the upper side of the lower head 185.

After the travel block 150 is moved to the inward position, the bolt 170 is moved upward back to the unlocked position. The bolt 170 is moved upward by supplying the fourth pressurized fluid F4 through the second fluid opening 1111B and into the upper internal chamber 173. The fourth pressurized fluid F4 pressurizes the second inner side 182 of the bolt 170 relative to the first inner side 181 of the bolt 170. The pressurizing the second inner side 182 relative to the first inner side 181 moves the bolt 170 upward. As the bolt 170 moves upward, third pressurized fluid F3 in the lower internal chamber 1010 exhausts through the first fluid opening 1111A. In one example, the fourth pressurized fluid F4 in the upper internal chamber 173 retains the bolt 170 upward in the unlocked position. The fourth pressurized fluid F4 may be sealed into the upper internal chamber 173 using one or more check valves disposed in one or more of the first and/or second fluid openings 1111A, 1111B. One or more check valves disposed in one or more of the first and/or second fluid openings 1111A, 1111B may also seal the third pressurized fluid F3 in the lower internal chamber 1010 to retain the bolt 170 downward in the locked position.

Although the bolt 170 is described herein as being actuated and moved between the locked position and the unlocked position using pressurized fluid (e.g. hydraulic actuation and/or pneumatic actuation), embodiments of the slip-type elevator assembly 100 may include at least one of manual actuation, hydraulic actuation, and pneumatic actuation of the bolt 170 to move the bolt 170 between the locked position and the unlocked position. For manual actuation, the bolt 170 may be actuated by a threaded engagement, a spring mechanism, a lever mechanism, or any other type of manual application. For example of manual actuation, the outer surface of the shaft 177 of the guide rod 175 may include threads that engage threads formed on the inner surface of the nut 174 and/or the bolt 170 such that rotation of the guide rod 175 and the shaft 177 in one direction (e.g. clockwise direction) moves the bolt 170 downward relative to the shaft 177 into the locked positon, and such that rotation of the guide rod 175 and the shaft 177 in the opposite direction (e.g. counter-clockwise direction) moves the bolt 170 upward relative to the shaft 177 into the unlocked positon. Rather than being fixed, the upper head 176 of the guide rod 175 may be rotatably mounted to the first door 110 such that a tool (e.g. a wrench) can be used to engage the upper head 176 and rotate the guide rod 175 to actuate the bolt 170 as described above.

Figure 2:
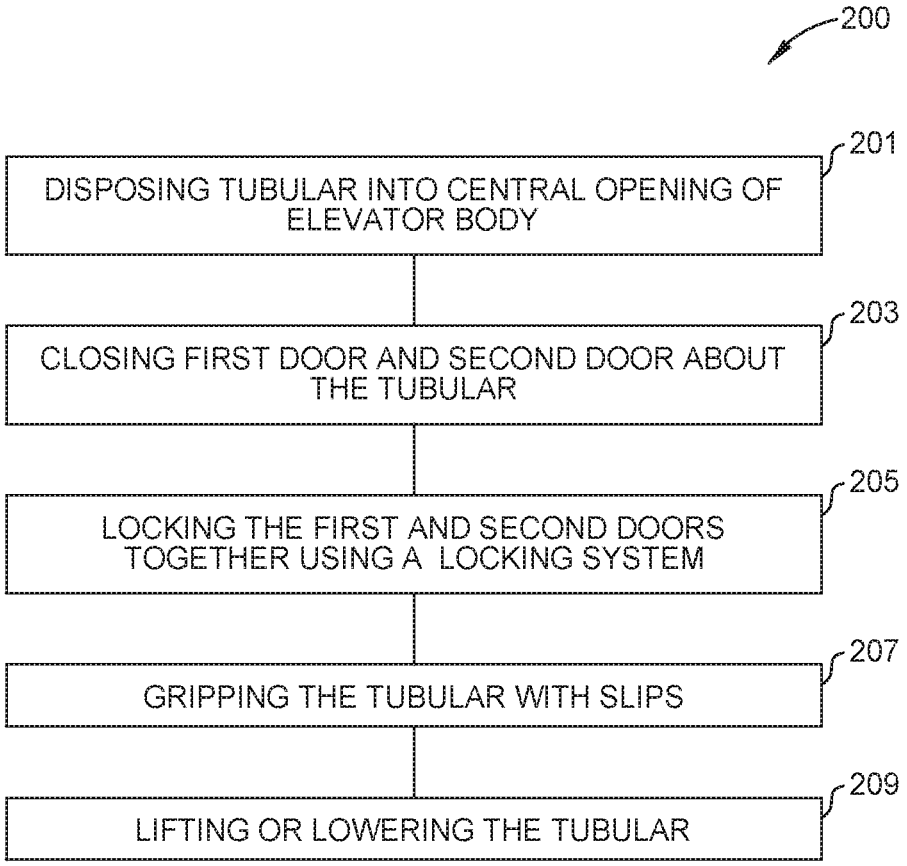
FIG. 2 is a schematic illustration of a method of manipulating a tubular using a slip-type elevator, according to one implementation.

FIG. 2 is a schematic illustration of a method 200 of manipulating a tubular using a slip-type elevator, according to one implementation. Block 201 includes disposing the tubular into a central opening of an elevator body of the slip-type elevator. In one example, the disposing the tubular includes moving the tubular through a throat of the elevator body and into the central opening by moving the tubular and/or by moving the elevator body relative to the tubular.

Block 203 includes closing a first door and a second door of the slip-type elevator about the tubular. The first door includes a first cavity formed in a first protrusion and a bolt disposed in the first cavity in an unlocked position. The closing the first door and the second door includes pivoting the first door and the second door relative to the elevator body and towards each other. The closing also includes vertically aligning the first cavity with a second cavity formed in a second protrusion of the second door. In one example, the first door and the second door are closed by actuating a first actuator and a second actuator, respectively, to pivotably extend or retract the respective first door and second door. The first actuator and the second actuator may actuate by extending, retracting, pivoting, and/or rotating. In one example, the first door is closed simultaneously with the second door at block 203. Closing the first door and the second door simultaneously reduces or eliminates the need for closing the respective doors in a specific order. Closing the first door and the second door simultaneously facilitates increased operational efficiencies, reduced operational times, and reduced operational costs.

Block 205 includes locking the first door and the second door together using a locking system. Locking the first door and the second door together includes moving a bolt of the locking system at least partially into the second cavity formed in the second protrusion to a locked position. In one example, the bolt is moved through the second cavity and into a cavity formed in a lower first protrusion of the first door. The lower first protrusion is disposed below the first protrusion of the first door.

Block 207 includes gripping the tubular with one or more slips of the slip-type elevator with the tubular. The slips described for block 207 may be engaged with the tubular prior to, simultaneously with, or after the operations described for one or more of blocks 201, 203, 205, and/or 207. In one example, one or more body slips coupled to the elevator body are engaged with the tubular when the tubular is disposed into the central opening at block 201. In one example, one or more second slips coupled to the first door and/or the second door are engaged with the tubular during the closing of the first door and the second door at block 203. A downward force applied to the slips by the weight of the tubular causes the slips to slide down the angled surfaces of the elevator body, the first door, and the second door, and move radially inward toward each other and into engagement with the tubular to grip and hold the tubular.

Block 209 includes lifting or lowering the tubular using the slip-type elevator. The slip-type elevator lifts the tubular using a gripping force applied to the tubular by the slips. In one example, the tubular is lifted from a catwalk trough to a rig floor for use in oil and gas operations, such as casing operations. In one example, the tubular is a casing tubular.

Benefits of the present disclosure include reduced or eliminated bolt failure, mitigated effects of high belt forces, increased reliability, increased operational efficiencies, reduced operation times, and the ability to close elevator doors simultaneously. It is contemplated that one or more of the aspects disclosed herein may be combined. Moreover, it is contemplated that one or more of these aspects may include some or all of the aforementioned benefits.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The present disclosure also contemplates that one or more aspects of the embodiments described herein may be substituted in for one or more of the other aspects described. The scope of the disclosure is determined by the claims that follow.

We claim:

1. A slip-type elevator assembly, comprising:

an elevator body comprising one or more slips configured to grip a tubular;

a first door pivotably coupled to the elevator body;

a second door pivotably coupled to the elevator body, the first door and the second door movable between an open position and a closed position;

a locking system comprising a bolt movable between an unlocked position and a locked position, wherein in the unlocked position the bolt is disposed in a first cavity formed in the first door, wherein in the locked position a first portion of the bolt is disposed in the first cavity and a second portion of the bolt is disposed outside of the first cavity, and wherein the locking system further comprises:

a guide rod mounted to the first door, the bolt being slidably disposed about a shaft of the guide rod; and a travel block disposed in a horizontal cavity formed in the first door, the travel block being movable between an inward position and an outward position, the travel block comprising a central opening, wherein the travel block is in the inward position when the bolt is in the unlocked position and the travel block is in the outward position when the bolt is in the locked position.

2. The slip-type elevator assembly of claim 1, wherein in the unlocked position, the bolt is in an upper position, and in the locked position the bolt is in a lower position that is below the upper position.

3. The slip-type elevator assembly of claim 1, wherein the bolt is movable from the unlocked position to the locked position by at least one of manual actuation, hydraulic actuation, and pneumatic actuation.

4. The slip-type elevator assembly of claim 1, wherein the bolt is in the unlocked position when the first door and the second door are in the open position, and the bolt is in the locked position when the first door and the second door are in the closed position.

5. The slip-type elevator assembly of claim 1, wherein in the locked positon the second portion of the bolt is in a second cavity formed in the second door.

6. A slip-type elevator assembly, comprising:

an elevator body comprising one or more slips configured to grip a tubular;

a first door pivotably coupled to the elevator body, the first door comprising a plurality of first protrusions;

a second door pivotably coupled to the elevator body, the second door comprising one or more second protrusions, the first door and the second door movable between an open position and a closed position, wherein in the closed position the plurality of first protrusions are interleaved with the one or more second protrusions;

a locking system comprising a bolt disposed in a first cavity formed in the first door and being movable between an unlocked position and a locked position, the bolt comprising a first end and a second end, wherein in the unlocked position the first end and the second end are disposed within the first cavity, wherein in the locked position the first end is disposed within the first cavity and the second end is disposed outside of the first cavity, and wherein the locking system further comprises:

a guide rod mounted to the first door, the bolt being slidably disposed about a shaft of the guide rod; and a travel block disposed in a horizontal cavity formed in the first door, the travel block being movable between an inward position and an outward position, the travel block comprising a central opening, wherein the travel block is in the inward position when the bolt is in the unlocked position and the travel block is in the outward position when the bolt is in the locked position.

7. The slip-type elevator assembly of claim 6, wherein in the unlocked position, the bolt is in an upper position, and in the locked position the bolt is in a lower position that is below the upper position.

8. The slip-type elevator assembly of claim 6, wherein the first door comprises a fluid conduit that is fluidly connected to a fluid source to supply a pressurized fluid to the bolt to pressurize a first inner side of the bolt relative to a second inner side and move the bolt from the unlocked position to the locked position.

9. The slip-type elevator assembly of claim 6, wherein the bolt is in the unlocked position when the first door and the second door are in the open position, and the bolt is in the locked position when the first door and the second door are in the closed position.

10. The slip-type elevator assembly of claim 6, wherein the first cavity formed in the first door is formed in an upper first protrusion of the plurality of first protrusions, the first cavity extending between an upper surface and a lower surface of the upper first protrusion.

11. The slip-type elevator assembly of claim 10, wherein a second protrusion of the one or more second protrusions comprises a second cavity formed in the second protrusion, the second cavity extending between an upper surface and a lower surface of the second protrusion.

12. The slip-type elevator assembly of claim 11, wherein as the bolt moves from the unlocked position to the locked position, the second end of the bolt moves from the first cavity, through the second cavity, and into a cavity formed in a lower first protrusion of the plurality of first protrusions.

13. The slip-type elevator assembly of claim 12, wherein in the closed position, the second protrusion is below the upper first protrusion, and the upper surface of the second protrusion interfaces with the lower surface of the upper first protrusion.

14. A method of manipulating a tubular using a slip-type elevator, comprising:

disposing the tubular into a central opening of an elevator body;

closing a first door and a second door about the tubular, the first door comprising a first cavity formed in a first protrusion and a bolt disposed in the first cavity in an unlocked position, the closing comprising:

pivoting the first door and the second door relative to the elevator body and towards each other, and aligning the first cavity with a second cavity formed in a second protrusion of the second door;

locking the first door and the second door together by moving the bolt at least partially into the second cavity formed in the second protrusion to a locked position;

prior to moving the bolt to the locked position, moving a travel block disposed in a horizontal cavity of the first door from an inward position to an outward position;

gripping the tubular with the slips; and lifting or lowering the tubular.

15. The method of claim 14, wherein the first door and the second door are closed simultaneously.

16. The method of claim 14, wherein the tubular is a casing tubular.

17. The method of claim 14, wherein the moving the bolt comprises pressurizing a first inner side of the bolt relative to a second inner side of the bolt, wherein in the unlocked position a first end and a second end of the bolt are within the first cavity, and in the locked position the first end is within the first cavity and the second end is outside of the first cavity.

18. A method of manipulating a tubular using a slip-type elevator, comprising:

disposing the tubular into a central opening of an elevator body;

closing a first door and a second door about the tubular, the first door comprising a first cavity formed in a first protrusion and a bolt disposed in the first cavity in an unlocked position, the closing comprising:

pivoting the first door and the second door relative to the elevator body and towards each other, and aligning the first cavity with a second cavity formed in a second protrusion of the second door;

locking the first door and the second door together by moving the bolt at least partially into the second cavity formed in the second protrusion to a locked position;

wherein the moving the bolt comprises pressurizing a first inner side of the bolt relative to a second inner side of the bolt, wherein in the unlocked position a first end and a second end of the bolt are within the first cavity, and in the locked position the first end is within the first cavity and the second end is outside of the first cavity;

gripping the tubular with the slips; and lifting or lowering the tubular.

19. A slip-type elevator assembly, comprising:

an elevator body comprising one or more slips configured to grip a tubular;

a first door pivotably coupled to the elevator body, the first door comprising a plurality of first protrusions;

a second door pivotably coupled to the elevator body, the second door comprising one or more second protrusions, the first door and the second door movable between an open position and a closed position, wherein in the closed position the plurality of first protrusions are interleaved with the one or more second protrusions;

a locking system comprising a bolt disposed in a first cavity formed in the first door and being movable between an unlocked position and a locked position, the bolt comprising a first end and a second end, wherein in the unlocked position the first end and the second end are disposed within the first cavity, wherein in the locked position the first end is disposed within the first cavity and the second end is disposed outside of the first cavity, and wherein the first door further comprises a fluid conduit that is fluidly connected to a fluid source to supply a pressurized fluid to the bolt to pressurize a first inner side of the bolt relative to a second inner side and move the bolt from the unlocked position to the locked position.

* * * * *